US006866592B1

(12) United States Patent
Gitre

(10) Patent No.: US 6,866,592 B1
(45) Date of Patent: Mar. 15, 2005

(54) SPORTS SWING AID AND TRAINING APPARATUS

(76) Inventor: Daniel J. Gitre, 4911 Winewood La., Commerce Township, MI (US) 48382

( * ) Notice: Subject to any disclaimer, the term of this patent is extended or adjusted under 35 U.S.C. 154(b) by 0 days.

(21) Appl. No.: 10/649,922

(22) Filed: Aug. 26, 2003

Related U.S. Application Data

(60) Provisional application No. 60/406,153, filed on Aug. 27, 2002.

(51) Int. Cl.[7] ..... A63B 69/36

(52) U.S. Cl. ..... 473/228; 473/206; 473/219; 473/256; 473/451; 473/437

(58) Field of Search ..... 473/206, 219, 473/223, 226, 230, 231, 238, 234, 453, 457; 482/93, 109, 111; 441/58, 59, 60, 122, 123; 206/522; 383/3; 53/474

(56) References Cited

U.S. PATENT DOCUMENTS

| | | | | | |
|---|---|---|---|---|---|
| 3,398,501 | A | * | 8/1968 | Aninger | 53/474 |
| 3,820,179 | A | * | 6/1974 | Maertin | 441/122 |
| 3,971,559 | A | * | 7/1976 | Diforte, Jr. | 473/437 |
| 4,964,827 | A | * | 10/1990 | Rudy | 441/59 |
| 5,058,890 | A | | 10/1991 | Szabo | |
| 5,207,625 | A | | 5/1993 | White | |
| 5,310,188 | A | | 5/1994 | Hernberg | |
| 5,395,107 | A | * | 3/1995 | De Pippo | 473/451 |
| 5,571,048 | A | | 11/1996 | Kenney | |
| D441,043 | S | | 4/2001 | Barnette | |
| 6,238,299 | B1 | | 5/2001 | Barnette | |
| 2001/0001094 | A1 | | 5/2001 | Panes | |

* cited by examiner

*Primary Examiner*—Gregory Vidovich
*Assistant Examiner*—Nini F. Legesse
(74) *Attorney, Agent, or Firm*—Carrier, Blackman & Associates, P.C.; William D. Blackman; Joseph P. Carrier

(57) ABSTRACT

A sports swing training apparatus, for use with a sports implement, is lightweight, portable, and easily manufactured. A first embodiment of the training apparatus includes a main body member having a core portion with a central opening formed therein, for placement surrounding a sports implement, which may be a golf club. The apparatus also includes a plurality of wings extending outwardly from a central core portion thereof when the body is inflated. In use, the wings provide wind resistance to assist a user in improving his or her swing. In another embodiment, the training apparatus is a unitary member formed from closed-cell plastic foam.

9 Claims, 8 Drawing Sheets

SPORTS SWING AID AND TRAINING APPARATUS

CROSS-REFERENCE TO RELATED APPLICATIONS

The present application claims priority of filing under 35 U.S.C. 119 based on U.S. Provisional application Ser. No. 60/406,153, filed Aug. 27, 2002.

BACKGROUND OF THE INVENTION

1. Field of the Invention

The present invention generally relates to sports swing training apparatus for use in connection with a sports implement, which may be a golf club. More specifically, the present invention relates to a sports swing training aid for adding resistance to a sports implement while practice swinging, to assist a user in improving his or her overall technique.

2. Description of the Background Art

Golf swing training products, of several designs and varieties, have been known in the prior art, and some of these products are commercially available today. Existing golf swing training products are often expensive to manufacture and may be heavy and/or cumbersome. The existing golf swing training products may include complex moving parts and may include numerous metal and/or plastic components. Many of the existing golf swing training products may be easily broken. The conventional 'weighted donut' golf swing training apparatus does not utilize wind resistance.

Examples of some issued patents on sports training apparatus are briefly described below.

U.S. patent 5,058,890, issued to Szabo in 1991 discloses a wind-resistance training device for use in connection with a baseball bat. The device of Szabo includes an elongated cylindrical sleeve with two sets of wings attached to and extending outwardly from the sleeve.

U.S. Patent 5,207,625, issued to White in 1993, discloses a swing motion device. The device of White has a plurality of collapsible wings mounted on a shaft that an athlete may grip and swing through the air. The wings provide air resistance against which the athlete's muscles must work. When the wings are collapsed, the device assumes a compact shape that facilitates transport and storage.

U.S. Pat. No. 5,310,188, issued to Hemberg in 1994, discloses a device for providing visual feedback to a golf player of his/her grip during a golf stroke. The apparatus of Hemberg helps a golfer maintain proper alignment of the golf club face in relation to the golf ball, while increasing the air resistance the player encounters during the golf stroke. The device includes a finned member, in which the fins are colored or otherwise marked, and subsequently attached on a golf club. The fins are oriented so that certain colors or other markings are not visible if the club head is in the desired position, but will be visible if the club head is in another orientation, e.g., open or closed. The fins also provide wind resistance during the swing. U.S. Pat. No. 5,571,048, issued to Kenney in 1996, discloses a golf swing practice device with a plurality of plastic "wings" that are airfoil-shaped for attaching to a golf shaft just above the head. The Kenney device utilizes wind resistance during a swinging of a golf club and the propeller-shaped wings cause a rotational torque to be exerted on the club, so as to promote proper club swing and rotation.

U.S. Pat. No. 6,238,299, issued to Barnette in 2001, discloses a device for warm-up and muscle memory prior to playing a game of golf, and is also useful for training a user to develop a grooved swing pattern, and to build up swing-related muscles. The Barnette device consists of a one-piece plastic molded baffle with a plurality of wings extending lengthwise of a golf club shaft. The apparatus has a slot opening formed between two of the wings, to allow attachment to a club shaft. Barnette also has a U.S. Design Patent, (D441, 043) for a similar invention.

U.S. Published Patent Application No. 2001/0001094, issued to Panes in 2001, discloses an exercise apparatus which may be used in various shapes/forms for various exercising activities, all of which shapes/forms include a resilient, inflatable ball and several associated weights. The embodiment shown in FIG. 7 of the Panes application pertains to a golf swing training device, in which the weighted, inflatable ball is attached to the end of a golf shaft.

Although the aforementioned prior art devices function as intended, a need still exists for a simple, inexpensive sports swing training device that can be easily carried, and which is useful for helping a user develop a swing which is natural, true and consistent.

SUMMARY OF THE INVENTION

The present invention provides an apparatus for use with a swingable sports implement in helping a user to improve his or her swing. The apparatus hereof can be adapted for use with a golf club, a baseball bat, or a hockey stick. The apparatus according to the invention is simple, portable and easy to use. The inventive apparatus does not add substantial weight to the sports implement or shaft, but instead, adds resistance to the sports implement while it is in motion.

In using the apparatus hereof, the resistance caused by the golf aid increases as the golfer increases the effort and speed at which the golfer swings the golf aid and club.

Because it is light in weight, the golf swing training aid hereof is not significantly affected by gravity, thereby providing a truer swing during use of the golf aid than many of the previously known devices.

A sports swing training apparatus according to a first illustrative embodiment of the present invention, generally, includes a lightweight, inflatable plastic body adapted to receive a shaft of a sports implement in a central portion thereof. The inflatable apparatus may include a sealable gas valve. The inflatable body has a core portion with a plurality of wings extending outwardly thereon for creating wind resistance. The number of wings used is preferred to be between 2 and 10. The inflatable body also has a central opening extending through the core portion thereof along its central axis.

Optionally, the apparatus may also include a closable slot formed through the core portion parallel to and in communication with the central opening, for allowing insertion of a sports implement, such as golf club shaft, into the central opening. Where used, the slot may have a fastener associated therewith.

In a second embodiment of a sports swing training apparatus according to the invention, the apparatus includes a main body manufactured formed from a low density closed-cell foam. The material used for the foam may be a polyethylene extrusion or other foam.

It is an object of the present invention is to provide a golf swing aid which is inexpensive to manufacture.

Another object of the present invention is to provide a golf swing aid which is lightweight and simple to use.

Yet another further object of the present invention is to provide a golf swing aid which has no moving parts.

Yet a further object of the present invention is to provide a golf swing aid which is substantially unbreakable under normal training conditions.

Still another object of the present invention is to provide a golf swing aid which is easily stored and transported in a golf bag.

Other objects, features, and advantages of the present invention will become apparent from the subsequent description and appended claims taken in conjunction with the accompanying drawings.

DETAILED DESCRIPTION

The attached drawings and explanation illustrate various embodiments of the present invention. Each of the disclosed embodiments is intended to be illustrative and exemplary, rather than to limit the scope of the invention.

Figure 1:
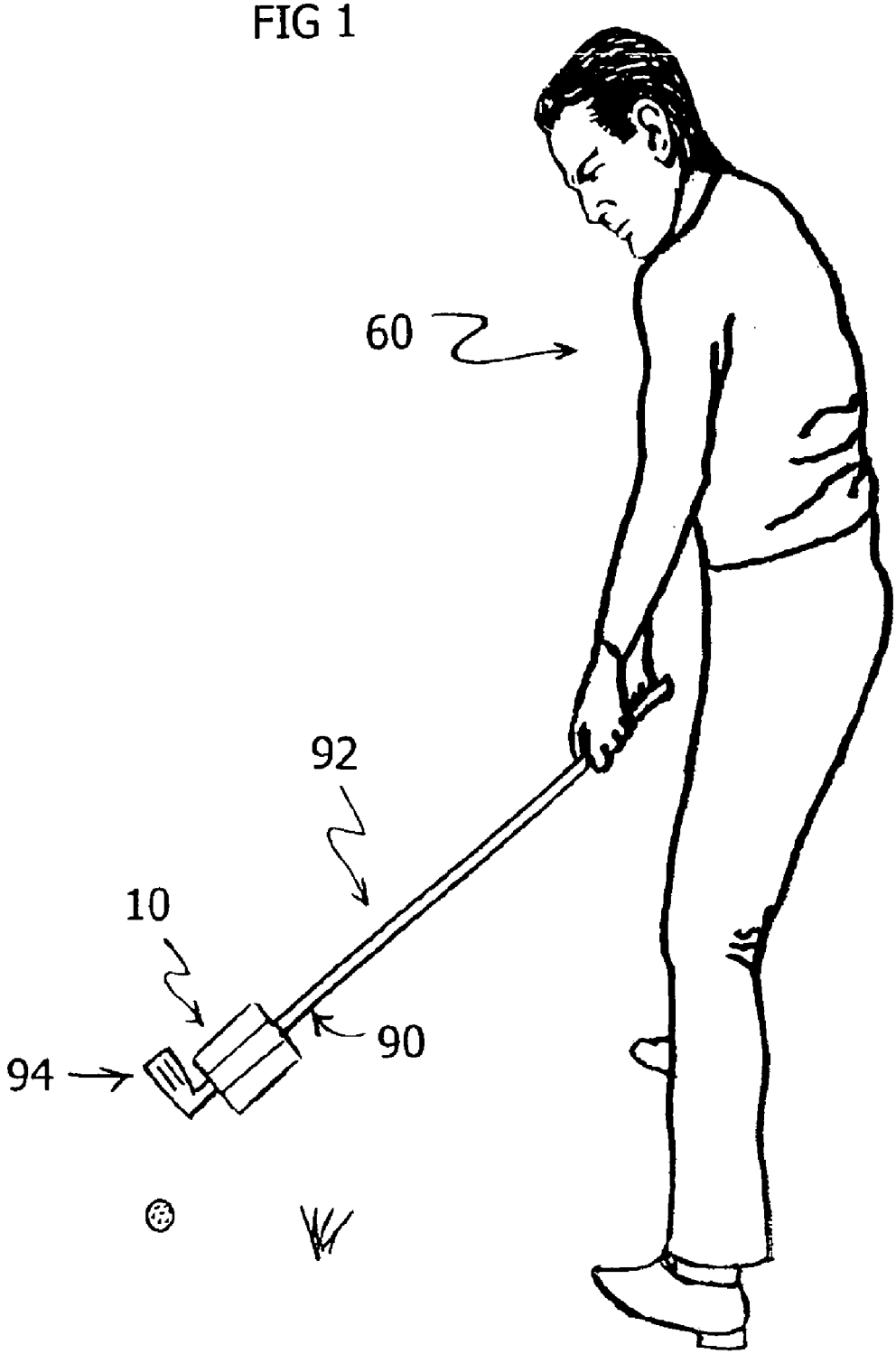
FIG. 1 is a side view of a golfer holding a golf club with a sports swing training apparatus according to a first embodiment of the present invention installed thereon.
Figure 2:
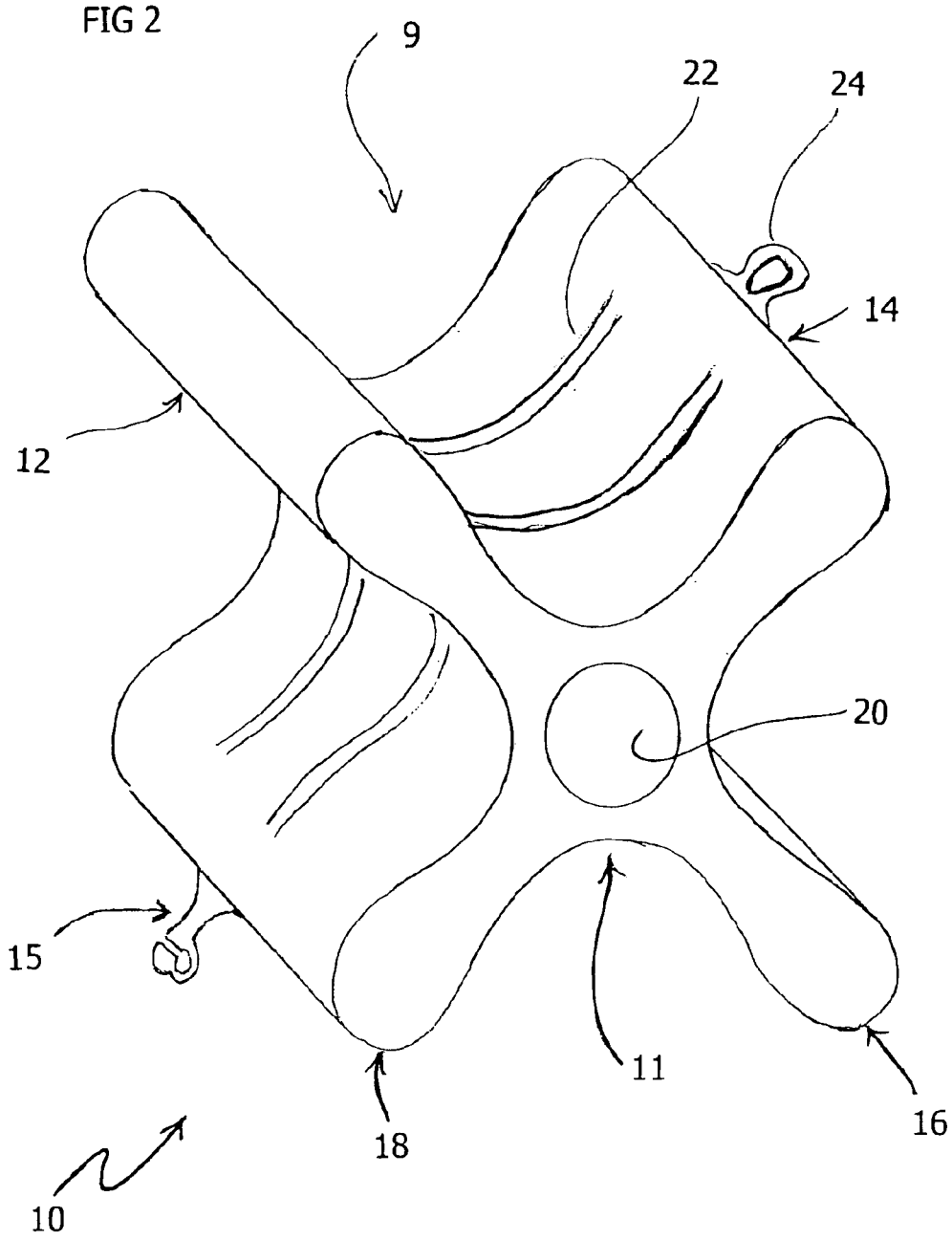
FIG. 2 is a perspective view of a sports swing training apparatus according to the first embodiment of the present invention.

A sports swing training apparatus according to a first embodiment of the invention is shown generally at 10 in FIGS. 1 and 2.

FIG. 1 depicts a user 60 working on improving his golf swing, with an apparatus 10 according to the first embodiment placed on a golf club 90 surrounding the shaft 92 thereof.

The apparatus 10 of FIG. 1, according to the first embodiment of the invention, is a one-piece inflatable plastic member. The apparatus 10 is substantially X-shaped in cross section, as shown, having a body member 9 with a core portion 11 having a central opening 20 formed therein. The central opening 20 extends completely through the body member along its central axis. The surface material immediately within the central opening 20 may have a felted, flocked fabric or other non-glossy surface to facilitate insertion and removal of a sports implement therethrough, such as a golf club handle and shaft 92.

The main body 9 of the apparatus 10 also includes four integrally formed wings 12, 14, 16 18 extending outwardly from the core portion 11 and spaced approximately 90 degrees apart. While four of the wings 12, 14, 16, 18 are shown, the apparatus 10 could be modified to include more or less of the wings. In the practice of the present invention, it is preferred to include between 2 and 10 wings on the main body.

The apparatus 10 also includes at least one valve 15 for use in inflating and deflating the apparatus.

As shown in FIG. 1, the apparatus 10 may be provided with an integral hook or eyelet 24 for connecting the member to a golf bag or the like.

As also shown, seams or ribs 22 may be provided on the apparatus 10 at the recessed areas between adjacent wings, to maintain the recessed areas in the substantially concave shape shown.

In the embodiment of FIG. 1, the apparatus 10 is constructed of vinyl or other appropriate plastic, of the general type used in manufacturing inflatable devices such as beach balls, air mattresses, and other inflatable beach toys. The apparatus 10 may be formed in any color(s), as desired.

Although the invention is not limited to any particular size, when the apparatus 10 is constructed and arranged for use with a golf club, an appropriate size could be in a range of 4"–12" diameter (tip end of one wing to tip end of an opposite wing)×6"–12" long, with larger size members creating greater resistance to swinging movements of the club. The central opening 14 may be 1¼"–2" diameter, noting that a normal golf club shaft handle is approximately 1" in diameter as its largest end.

In use, the apparatus 10 is first inflated using the valve 15, and when used in connection with a golf club 90, is then, slipped over the handle of a golf shaft 92 and slid down the shaft to a position adjacent the club head 94.

A golfer will then practice his or her golf swing with the apparatus 10 disposed on the club shaft 92, swinging the club back and forth in the normal way. Gravity and the centrifugal force resulting from swinging motion of the club 90 maintains the apparatus 10 adjacent the club head 94, even though the apparatus is very lightweight. The apparatus 10 may rotate about the golf club shaft 92 during use.

The apparatus 10 creates significant wind resistance as the club 90 is swung, so that after the golfer has taken a number of swings with the apparatus 10 installed on the club 90 and then removes the apparatus, the normal swinging action of the club seems almost effortless.

Second Embodiment

Figure 3:
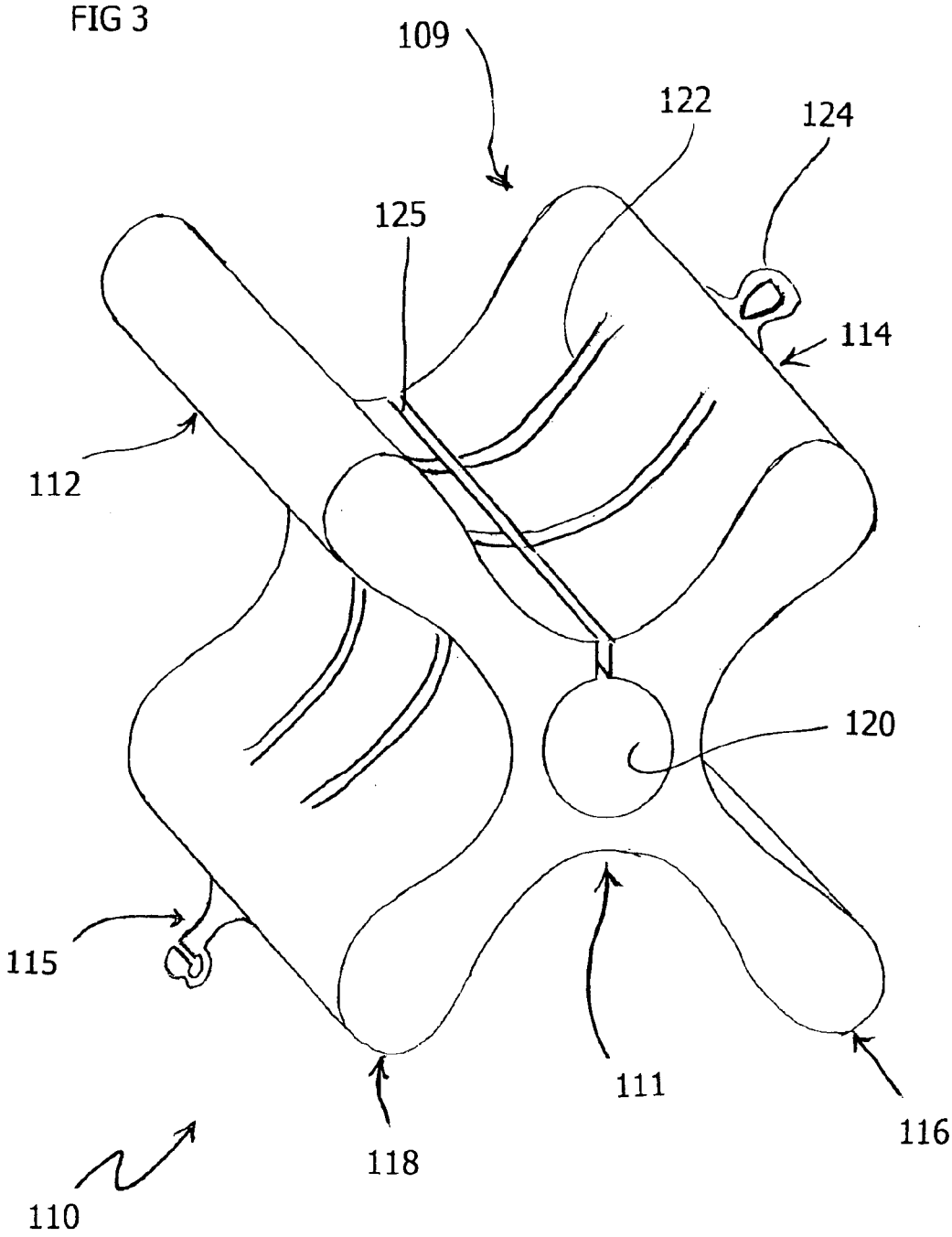
FIG. 3 is a perspective view of a sports swing training apparatus according to a second embodiment of the present invention, which is a modified form of the first embodiment.

A sports swing training apparatus in accordance with a second embodiment of the present invention is shown generally at 110 in FIG. 3.

The sports swing training apparatus 110 of FIG. 3 has many features in common with the sports swing training apparatus 10 of the first embodiment, as previously described.

All features of the sports swing training apparatus 110 in the second embodiment which are not specifically described herein as being different from those in the sports swing training apparatus 10 of the first embodiment, will be understood as being substantially similar or identical to the corresponding features of the sports swing training apparatus of the first embodiment, as previously described herein.

For example, the sports swing training apparatus 10 includes an inflatable body member 109 having a core portion 111, a plurality of wings 112, 114, 116, and 118 extending outwardly from the core portion, and a central opening 120 extending through the core portion, substantially identical to those components as described herein in connection with the first embodiment.

In the embodiment shown in FIG. 3, there is shown a slight modification of the body member 109 of the apparatus 110, as compared to the apparatus of the first embodiment. Particularly, the apparatus 110 is provided with a slit 125 extending fully along the axial length of the core portion 111, adjacent to and in communication with the central opening 120.

A fastener such as hook-and-loop type fastener (for example) such as VELCRO® or the like may be disposed on opposite faces of the core portion 111 adjacent the slit 125, to permit the slit to be selectively opened and closed. Such slit 125 facilitates placement of the apparatus on and off the shaft of a sports implement, such as the golf club 90 of FIG. 1, and allows the central opening 120 to be made smaller than it is in the first embodiment.

Third Embodiment

Figure 4:
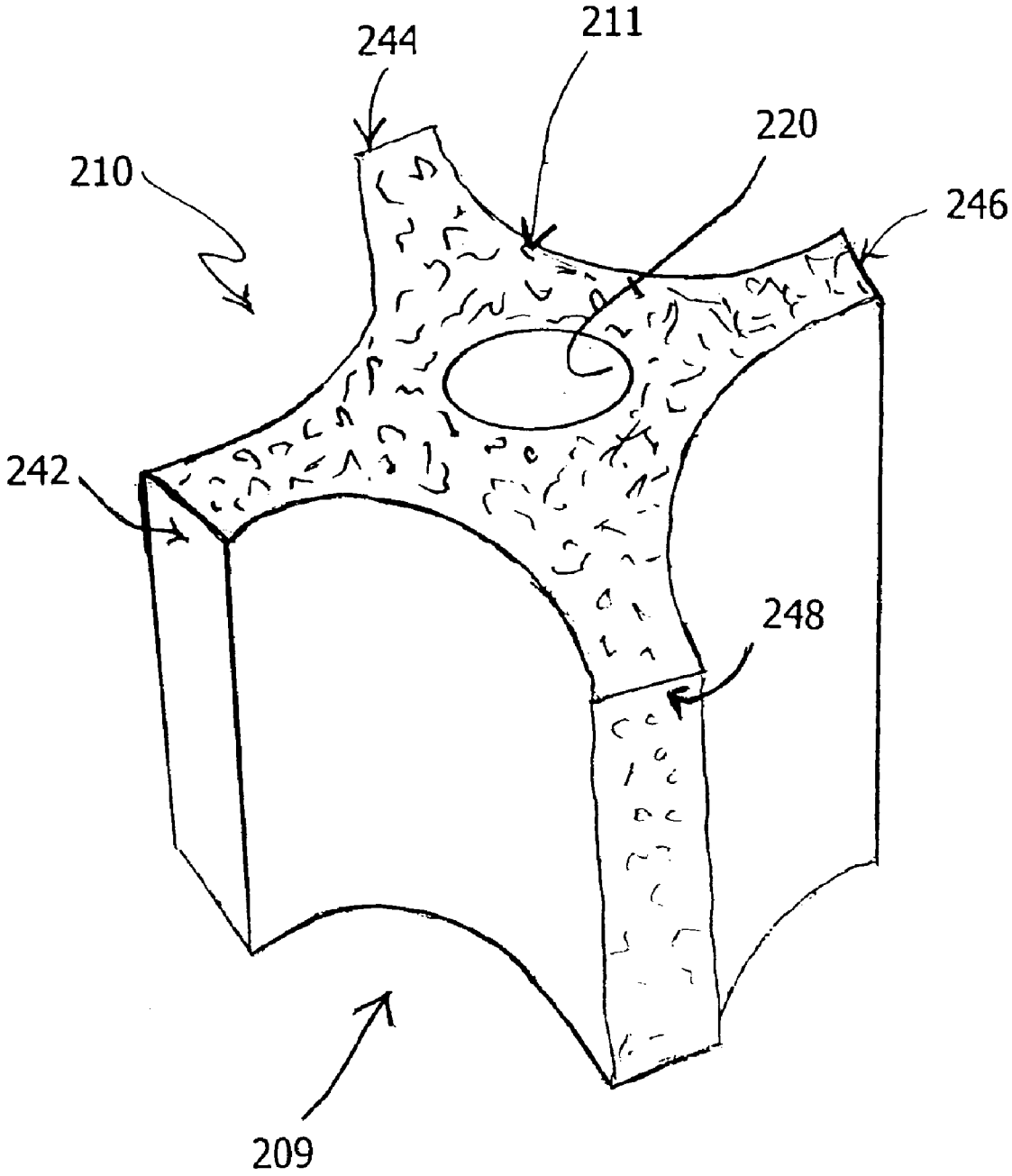
FIG. 4 is a perspective view of a sports swing training apparatus according to a third embodiment of the present invention.

Another alternate embodiment of a sports swing training apparatus 210 is shown in FIG. 4. The sports swing training apparatus 210 of FIG. 4 has many features in common with the sports swing training apparatus 10 of the first embodiment, as previously described.

All features of the sports swing training apparatus 210 in the third embodiment which are not specifically described herein as being different from those in the sports swing training apparatus 10 of the first embodiment, will be understood as being substantially similar or identical to the corresponding features of the sports swing training apparatus of the first embodiment, as previously described herein.

For example, the sports swing training apparatus 210 includes a main body member 209 having a core portion 211, a plurality of wings 242, 244, 246, and 248 extending outwardly from the core portion, and a central opening 220 extending through the core portion, similar to those components as described herein in connection with the first embodiment. The central opening 220 extends completely through the body member 209 along its central axis.

However, in this embodiment, the main body member 209 is not inflatable. Instead, the body member 209, in this embodiment, is made of lightweight, resilient closed-cell foam. The member 240 is constructed from a polyethylene extrusion or a similar plastic or elastomeric foam material. One example of a material which may be used to form the apparatus 240 according to the embodiment of FIG. 3, is the material used to manufacture elongated floating noodles currently used as floatation and amusement devices for swimming pools.

In the embodiment of FIG. 4, a sports swing training apparatus 210 according to the invention comprises a unitary body member 209, which is substantially X-shaped in cross section, with a central core portion 211 having a hollow opening 220 formed therethrough to receive a shaft of a sports implement, such as a baseball bat, hockey stick or golf club.

The apparatus 210 of FIG. 4 also has four wings 242, 244, 246, 248 integrally formed with and extending outwardly from the core portion 211, and spaced approximately 90 degrees apart from one another. The wing sections 242, 244, 246, 248 will be seen to have flattened outer ends in this embodiment.

The apparatus 210 is again light in weight, but not as lightweight as the inflatable apparatus 10 of the first embodiment. In terms of size, the member 240 may have dimensions similar to those of the apparatus 10 discussed above, but will more likely have smaller dimensions than the inflatable apparatus 10, e.g., 4"–8" diameter and 4"–10" length. The diameter of the central opening 220 may be in the same range as discussed in relation to apparatus 10. Use of the member 240 is the same as with the apparatus 10 according to the first embodiment, except that member 240 is not required to be inflated or deflated.

Fourth Embodiment

Figure 5:
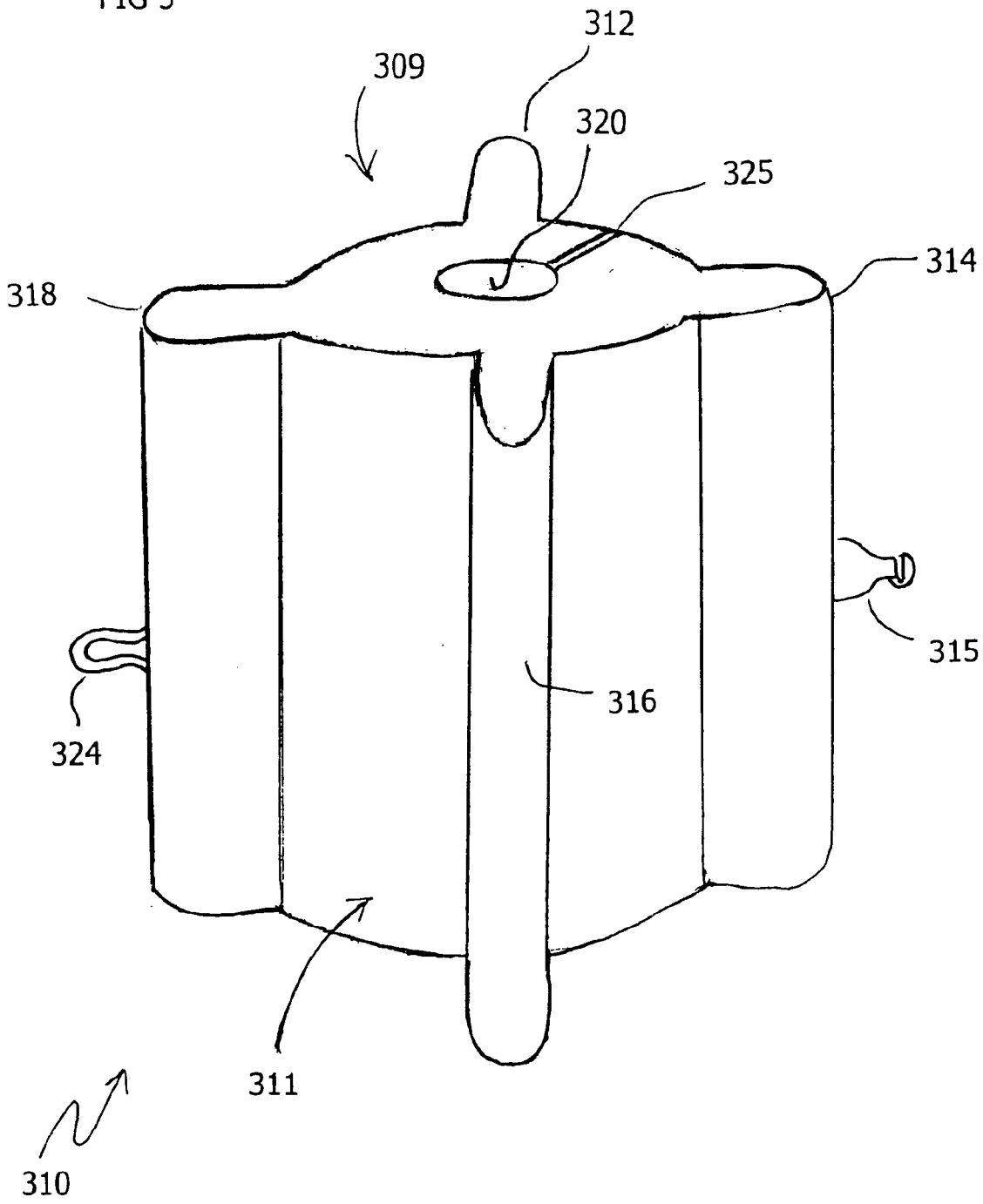
FIG. 5 is a perspective view of a sports swing training apparatus according to a fourth embodiment of the present invention.
Figure 6:
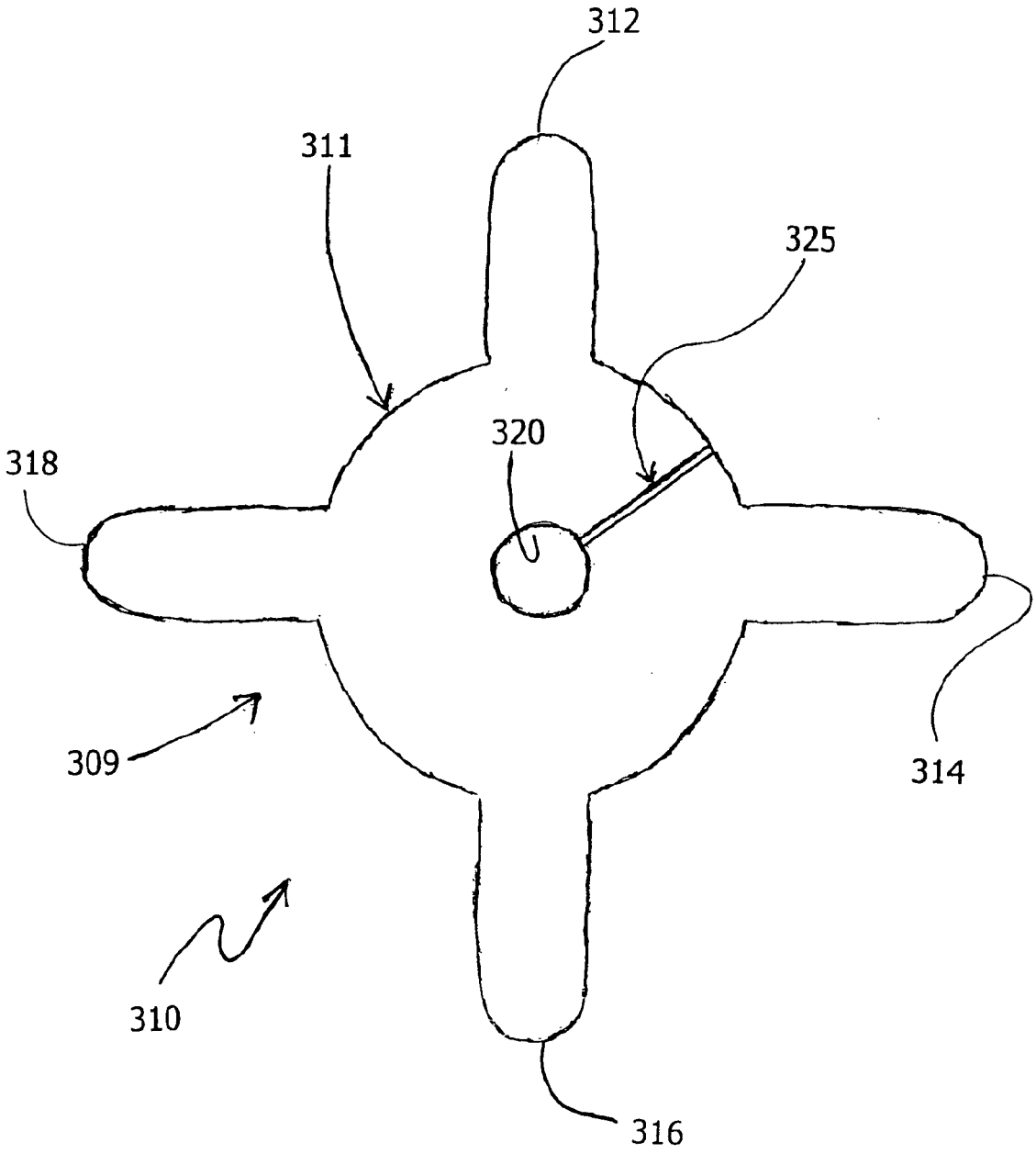
FIG. 6 is a top plan view of the apparatus of FIG. 5.

Another alternate embodiment is shown in FIGS. 5 and 6. This embodiment is similar to the embodiment as shown in FIG. 1, with the exception that the recessed areas of the core member, between the adjacent wings, are not present. In this embodiment, the core portion 311 has a cylindrical shape to it when inflated.

The apparatus 310 of FIGS. 5–6, according to the fourth embodiment of the invention, is a one-piece inflatable plastic member. The apparatus 310 is substantially X-shaped in cross section, as shown, having a main body member 309 with a core portion 311 having a central opening 320 formed therein. The central opening 320 extends completely through the main body member 309 along its central axis. The surface material immediately within the central opening 320 may have a felted, flocked fabric or other non-glossy surface to facilitate insertion and removal of a sports implement therethrough, such as a golf club handle and shaft 92.

The main body 309 of the apparatus 310 also includes four integrally formed wings 312, 314, 316 and 318 extending outwardly from the core portion 311 and spaced approximately 90 degrees apart. While four of the wings 312, 314, 316, 318 are shown, the apparatus 10 could be modified to include more or less of the wings. In the practice of the present invention, it is preferred to include between 2 and 10 wings on the main body member 309.

The apparatus 310 also includes at least one valve 315 for use in inflating and deflating the apparatus.

As shown in FIG. 5, the apparatus 310 may be provided with an integral hook or eyelet 324 for connecting the member to an accessory, such as a golf bag (not shown) or the like.

In the embodiment of FIG. 5, the apparatus 310 is constructed of vinyl or other appropriate plastic, of the general type used in manufacturing inflatable devices such as beach balls, air mattresses, and other inflatable beach toys. The apparatus 310 may be formed in any color(s), as desired.

Optionally, the core portion 311 of the main body member 309 may have a slit formed therethrough in communication with the central opening 320. Where the slit 325 is used, the main body member 309 may have one or more fasteners attached to the core portion on the inward-facing sides of the slit. Hook and loop fasteners are acceptable in the practice of the invention.

Fifth Embodiment

Figure 7:
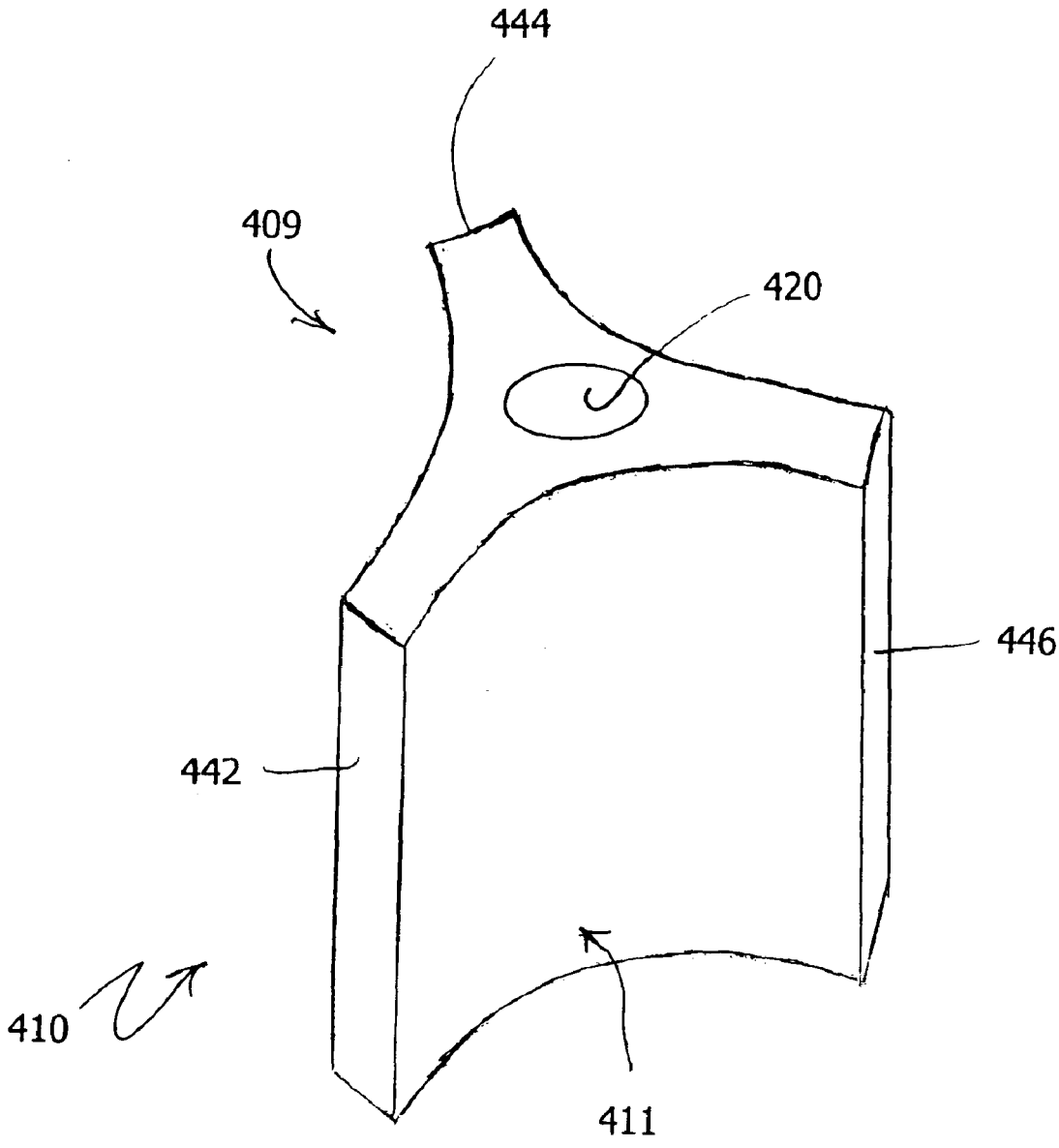
FIG. 7 is a perspective view of a sports swing training apparatus according to a sixth embodiment of the present invention.

Another alternate embodiment of a sports swing training apparatus 410 is shown in FIG. 7. The sports swing training apparatus 410 of FIG. 7 has many features in common with the sports swing training apparatus 10 of the first embodiment, as previously described.

All features of the sports swing training apparatus 410 in the fifth embodiment which are not specifically described herein as being different from those in the sports swing training apparatus 10 of the first embodiment, will be understood as being substantially similar or identical to the corresponding features of the sports swing training apparatus of the first embodiment, as previously described herein.

For example, the sports swing training apparatus 410 of FIG. 7 includes a main body member 409 having a core portion 411, a plurality of wings 442, 444, and 446 extending outwardly from the core portion, and a central opening 420 extending through the core portion, similar to those components as described herein in connection with the first embodiment. The central opening 420 extends completely through the body member 409 along its central axis.

However, in this embodiment, the main body member 409 is not inflatable. Instead, the body member 409, in this embodiment, is made of lightweight, resilient closed-cell foam. The body member 409 is constructed from a polyethylene extrusion or a similar plastic or elastomeric foam material. One example of a material which may be used to form the apparatus 410, according to the embodiment of FIG. 7, is the material used to manufacture elongated floating noodles currently used as floatation and amusement devices for swimming pools.

In the embodiment of FIG. 7, a sports swing training apparatus 410 according to the invention comprises a unitary body member 409, which is substantially Y-shaped in cross section, with a central core portion 411 having a hollow opening 420 formed therethrough to receive a shaft of a sports implement, such as a baseball bat, hockey stick or golf club.

The apparatus 410 of FIG. 7 also has three wings 442, 444, and 446 integrally formed with and extending outwardly from the core portion 411, and spaced approximately 120 degrees apart from one another.

The apparatus 410 is again light in weight, but not as lightweight as the inflatable apparatus 10 of the first embodiment. Use of the apparatus 410 is the same as with the apparatus 210 according to the third embodiment, shown in FIG. 4.

As discussed herein in connection with the previous embodiments, the apparatus 410 may have a slit formed in the core portion thereof, parallel to and in communication with the central opening, to facilitate installation thereof on a shaft of a sports implement.

Sixth Embodiment

Figure 8:
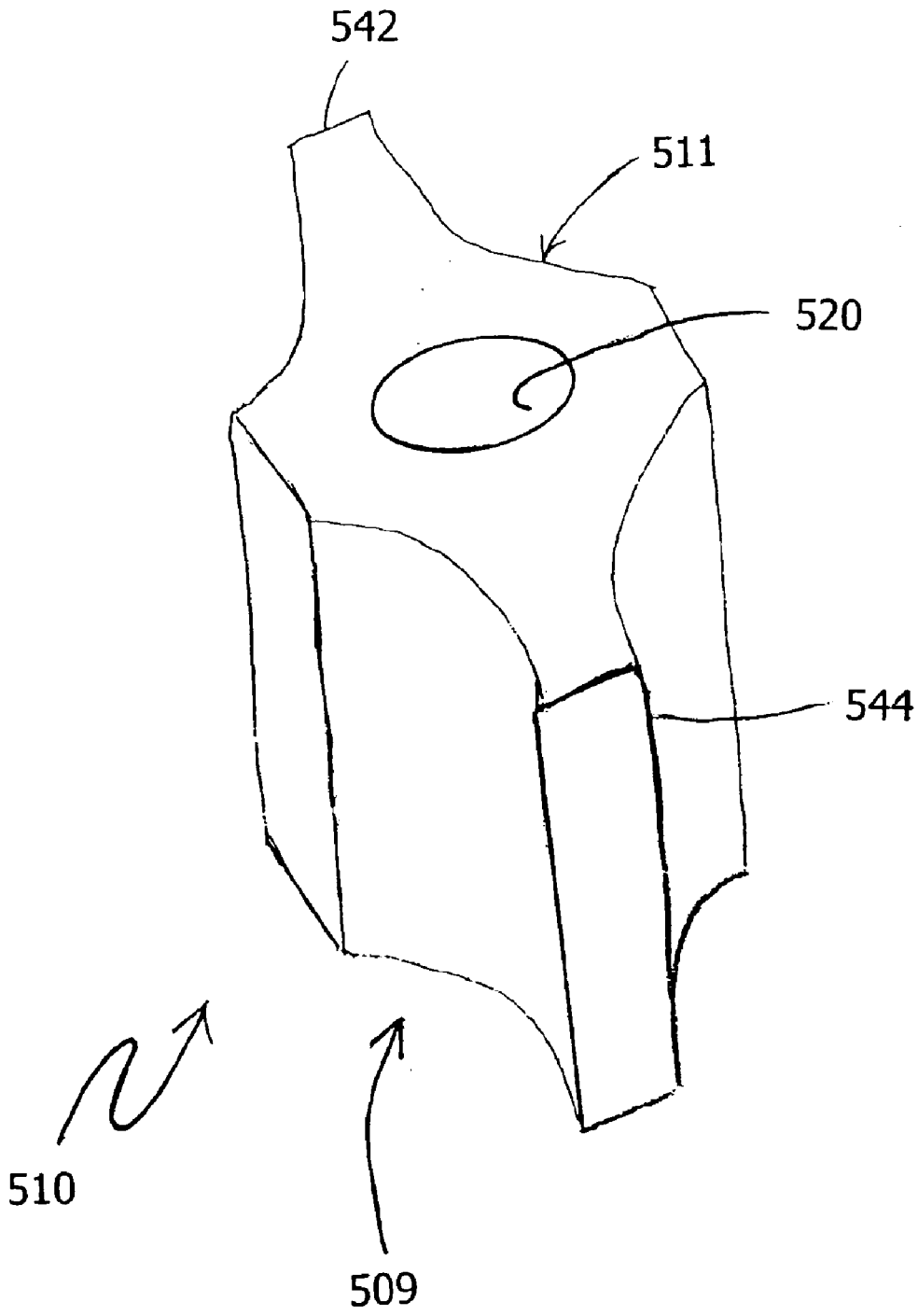
FIG. 8 is a perspective view of a sports swing training apparatus according to a seventh embodiment of the present invention.

Another alternate embodiment is shown in FIG. 8. In this embodiment, the body member 509 has a similar shape as the body member 409 shown in FIG. 7, with the exception of having two adjacent wings 542, 544 instead of three. The two wing members 542, 544 extend radially in opposite parallel directions from the body member. The two wings 542, 544 are spaced approximately 180 degrees apart and a central opening 520 extends completely through the core portion 51 of the main body member 509 along its central axis.

The body member 509, in this embodiment, is made of lightweight, resilient closed-cell foam. The body member 509 is constructed from a polyethylene extrusion or a similar plastic or elastomeric foam material.

As discussed herein in connection with the previous embodiments, the apparatus 510 may have a slit formed in the core portion thereof, parallel to and in communication with the central opening, to facilitate installation thereof on a shaft of a sports implement.

The depicted shapes are merely exemplary shapes that may be used according to the invention, but the invention is not limited thereto.

Although there have been described what are the present embodiments of the invention, it will be understood by persons skilled in the art that variations and modifications may be made thereto without departing from the gist, spirit or essence of the invention. For example, instead of being a blow-up member or a foam member, the sports swing aid could be formed as hollow plastic members with a fixed shape which is not inflatable or deflatable, and may be manufactured using blow molding, vacuum forming or other appropriate technologies conventionally formed used in manufacturing children's plastic toy blocks or the like, to create equivalent structures to those described herein.

Also, while the aid may be conveniently formed and used as a single unitary member according to the invention, the aid could be formed with smaller lengths and/or sizes, and a plurality of the aids could be used together. Still further, while the swing aid has been described for use in relation to a golf swing training device, the swing aid certainly could be used in relation to other devices with little or no modification, e.g., with baseball bats, hockey sticks, cricket bats, ect.

I claim:

1. A sports swing training apparatus for use in conjunction with a sports implement, the apparatus comprising:

a hollow, inflatable plastic body member having a central axis and comprising a core portion with a central opening formed therein adapted to receive a shaft of the sports implement, said central opening extending through said body member along its central axis, and a plurality of wing sections attached to said core portion and extending outwardly therefrom in an inflated configuration of the apparatus; wherein said body member comprises a felted, flocked fabric or other non-glossy surface on the interior of said central opening.

2. The apparatus of claim 1, wherein said body member is substantially X-shaped in cross section, and wherein said wing sections are spaced substantially 90 degrees apart.

3. The apparatus of claim 1, wherein said body member further comprises ribs positioned thereon between adjacent wing sections.

4. The apparatus of claim 1, further comprising an attachment loop or hook attached to said body member for use in connecting said apparatus to an accessory.

5. A sports swing training apparatus comprising:

an elongate, one-piece body member comprising a unitary inflatable plastic member having a core portion and a central axis; and a plurality of wing sections integrally formed with and extending outwardly from said core portion;

wherein said body member has ventral opening formed therein that extends therethrough along its central axis, and wherein said apparatus comprises a felted flocked fabric or other non-glossy surface on the interior of said central opening.

6. The apparatus of claim 5, wherein said body member comprises a series of ribs located in the areas located between each wing section.

7. The apparatus of claim 5, wherein said body member is substantially X-shaped in cross section, and wherein said wing sections are spaced substantially 90 degrees apart.

8. A sports swing training apparatus for use in conjunction with a sports implement, the apparatus comprising:

a hollow, inflatable plastic body member having a central axis and comprising a core portion with a central opening formed therein adapted to receive a shaft of the sports implement, said central opening extending through said body member along its central axis, and a plurality of wing sections attached to said core portion and extending outwardly therefrom in an inflated configuration of the apparatus;

wherein said body member further comprises ribs positioned thereon between adjacent wing sections; wherein said body member comprises a felted, flocked fabric or other non-glossy surface on the interior of said central opening.

9. The apparatus of claim 8, further comprising an attachment loop or book attached to said body member for use in connecting said apparatus to an accessory.

* * * * *